US009484675B2

(12) United States Patent
Chen et al.

(10) Patent No.: US 9,484,675 B2
(45) Date of Patent: Nov. 1, 2016

(54) TERMINAL STRUCTURE OF ELECTRICAL CONNECTOR

(71) Applicant: SPEED TECH CORP., Taoyuan (TW)

(72) Inventors: Chih-Cheng Chen, Taoyuan (TW); Robert Chiang, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 14/806,670

(22) Filed: Jul. 23, 2015

(65) Prior Publication Data

US 2016/0028190 A1 Jan. 28, 2016

(30) Foreign Application Priority Data

Jul. 28, 2014 (TW) ..... 103213390 U

(51) Int. Cl.

| | |
|---|---|
| ***H01R 13/648*** | (2006.01) |
| ***H01R 13/6581*** | (2011.01) |
| ***H01R 12/57*** | (2011.01) |
| *H01R 13/6587* | (2011.01) |

(52) U.S. Cl.

CPC ..... *H01R 13/6581* (2013.01); *H01R 12/57* (2013.01); *H01R 13/6587* (2013.01)

(58) Field of Classification Search

USPC ..... 439/607.4

See application file for complete search history.

(56) References Cited

U.S. PATENT DOCUMENTS

| | | | | |
|---|---|---|---|---|
| 7,909,653 | B1 * | 3/2011 | Wan | H01R 13/514 439/660 |
| 7,942,704 | B2 * | 5/2011 | Ko | H01R 13/6477 439/607.1 |
| 8,079,854 | B2 * | 12/2011 | He | H01R 13/6467 439/108 |
| 8,568,172 | B1 * | 10/2013 | Lan | H01R 12/57 439/607.4 |
| 8,740,649 | B2 * | 6/2014 | Lan | H01R 13/506 439/607.4 |
| 8,882,515 | B2 * | 11/2014 | Lv | H01R 13/6581 439/607.35 |
| 9,136,649 | B2 * | 9/2015 | Shih | H01R 13/658 |
| 2013/0078859 | A1 * | 3/2013 | Hori | H01R 13/6581 439/607.55 |

FOREIGN PATENT DOCUMENTS

TW M469651 U 1/2014

* cited by examiner

*Primary Examiner* — Tho D Ta

(74) *Attorney, Agent, or Firm* — CKC & Partners Co., Ltd.

(57) ABSTRACT

A connector includes a shielding case, an insulating main body and a terminal group. The shielding case has an opening for allowing a docking plug to insert therein. The insulating main body is covered by the shielding case. The terminal group is accommodated in the insulating main body. The terminal group has terminals. Each of the terminals has a contact portion and a connecting portion. The contact portion is arranged in two rows in the opening of the shielding case. The connecting portions are fixed to the insulating main body. The connecting portions of a portion of the terminals extend outwards from the insulating main body to form welding legs arranged in the same row.

6 Claims, 6 Drawing Sheets

TERMINAL STRUCTURE OF ELECTRICAL CONNECTOR

RELATED APPLICATIONS

This application claims priority to Taiwanese Application Serial Number 103213390, filed Jul. 28, 2014, which is herein incorporated by reference.

BACKGROUND

1. Technical Field

The present disclosure relates to a connector. More particularly, the present disclosure relates to a connector which can combine two rows of terminals as one single row electrically connected to an electric circuit, and the terminals with uniform functions are distributed on the same region of the electric circuit by using a staggered arrangement.

2. Description of Related Art

Electrical connectors such as universal serial bus (USB) connectors and high definition multimedia interface (HDMI) connectors are largely used in the field of communication. How to reduce the manufacturing cost of the electrical connectors is an important factor to gain a competitive position in the market. A key component of an electrical connector is a terminal module, which generally includes an insulating main body and plural terminals partially supported in the insulating main body. Most of the terminal modules of the existing electrical connectors include two groups of terminals. Moreover, the two groups of terminals are in general electrically connected to a circuit board in a parallel manner. A conventional double rows welding likely causes the terminals located in the inner row to have solder empty which cannot be repaired. In order to effectively control the accuracy of welding the terminals, in the manufacturing process of the terminal modules, the industry has provided an improved structure for the terminals, in which the welding legs of the two groups of terminals are pulled outwards to form the same row. This manner of single row will not cause the phenomenon of solder empty.

The aforementioned manufacturing method provides an electrical connection method which enables a single row of terminals to be positioned on an electric circuit board by using a Surface Mounting Technology (SMT). As shown on FIG. 7, Taiwan Patent Publication No. M469651 provides an improved structure of USB3.0 connector which includes a terminal assembly A1. The terminal assembly A1 includes a first differential signal transmission conductor group A11, a second differential signal transmission conductor group A12, a first grounding transmission conductor A13, a first signal transmission conductor A14, a second signal transmission conductor A15, a power transmission conductor A16 and a third grounding transmission conductor A17. An end of the first differential signal transmission conductor group A11 forms a first differential signal welding group A112. An end of the second differential signal transmission conductor group A12 forms a second differential signal welding group A122 at a side of the differential signal welding group A112. On end of the first grounding transmission conductor A13 diverges and splits to form a first grounding base A1311 and a second grounding base A1312. An end of the first grounding base A1311 defines a first grounding welding portion A1313 located between the first differential signal welding group A112 and the second differential signal welding group A122. An end of the second grounding base A1312 defines a second grounding welding portion A1314 located between the second differential signal welding group A122 and the first grounding welding portion A1313. An end of the first signal transmission conductor A14 defines a first signal welding portion A142 located between the first grounding welding portion A1313 and the second grounding welding portion A1314. An end of the second signal transmission conductor A15 defines a second signal welding portion A152 located between the first signal welding portion A142 and the second grounding welding portion A1314. An end of the power transmission conductor A16 forms a power welding portion A162 located between the first differential signal welding group A112 and the first grounding welding portion A1313. An end of the third grounding transmission conductor A17 forms a third grounding welding portion A172 located between the second differential signal welding group A122 and the second grounding welding portion A1314.

Because being too thin, each terminal of the first differential signal transmission conductor group A11, the second differential signal transmission conductor group A12 and the first grounding transmission conductor A13 will be easily bent, broken and damaged by unexpected external factors during the manufacturing process. Moreover, due to the slope in appearance of the terminal combination A1, it is not easy to position the terminal combination A1 accurately during assembly, and thus the overall yield rate cannot be effectively increased. Therefore, it becomes an issue to be solved in production.

SUMMARY

A technical aspect of the present disclosure provides a connector which reserves the welding legs of two groups of terminals which are required to be used, and bends and breaks the other welding legs which are not to be used. The welding legs reserved are staggered to form one single row, and the welding legs with compatible functions are allocated together. When the two groups of terminals employs the Surface Mounting Technology (SMT), the errors caused by solder empty are reduced. Moreover, the overall volume is effectively reduced due to the proper position allocation, and the standard product specifications can be met. In addition, the structure of the product design of the connector is relatively simple, thus effectively increasing the yield rate of mass production in the manufacture of the final products.

According to an embodiment of the present disclosure, a connector includes a shielding case, an insulating main body and a terminal group. The terminal group is accommodated in the insulating main body. The insulating main body is covered by the shielding case. The shielding case has an opening for allowing a docking plug to insert therein. The terminal group has plural terminals. Each of the terminals has a contact portion and a connecting portion. The contact portions are arranged in two rows in the opening of the shielding case. The connecting portions are fixed to the insulating main body. The connecting portions of a portion of the terminals extend outwards from the insulating main body to form a plurality of welding legs. The welding legs are arranged in the same row.

According to an embodiment of the present disclosure, the terminal group includes an upper terminal row and a lower terminal row. The upper terminal row includes two grounding legs GND, two power supply legs Vbus, a transmission leg D+, a receiving leg D−, and a first signal leg CC1. The lower terminal row includes two grounding legs GND, two power supply legs Vbus, a transmission leg D+, a receiving leg D−, and a second signal leg CC2. Each of the grounding legs GND of the upper terminal row and the lower terminal row are placed in the same region on the circuit board, and the region is configured for grounding. Each of the power supply legs Vbus of the upper terminal row and the lower terminal row are placed in the same block on the circuit board, and the block is configured for power transmission.

According to an embodiment of the present disclosure, the welding legs of the upper terminal row and the lower terminal row are staggered to form the same row. Each of the grounding legs GND, each of the power supply legs Vbus, each of the transmission legs D+, each of the receiving legs D−, the first signal leg CC1 and the second signal leg CC2 are formed by pulling outwards to bend by the manner of staggering, configured to form a single row matching with the circuit design of the electric circuit. The terminal group is electrically connected to the circuit board in compliance with the Surface Mounting Technology (SMT).

According to an embodiment of the present disclosure, the upper terminal row and the lower terminal row have broken legs, and the broken legs are the terminals with no function. Only the contact portion and the connecting portion of the broken legs are reserved. The contact portion is to be electrically connected to a docking plug. The connecting portion is configured to assist the accuracy of mutual positioning the terminal group and the insulating main body during assembly. When the connector is electrically connected to a docking plug, the docking plug can be electrically connected to the connector successfully no matter whether the docking plug is inserted in the right direction or in the reverse direction.

The other applications of the present disclosure become obvious from the disclosure. However, the disclosure is directed to forming one single row of terminals by pulling outwards each of the welding legs of an upper terminal row and a lower terminal row, so as to reinforce each of the terminals while the surface mounting technology is performed, without causing solder empty problems for terminals. Moreover, the appearance of each of the terminals is maintained at a certain dimension, such that the terminals will not be easily bent, broken or damaged by external factors. In addition, the structure of product design is simple. Thus, the production process can be effectively simplified and the manufacturing cost can be reduced. It will be apparent to the person having ordinary skill in the art that various modifications and variations can be made to the structure of the present disclosure without departing from the scope or spirit of the present disclosure.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
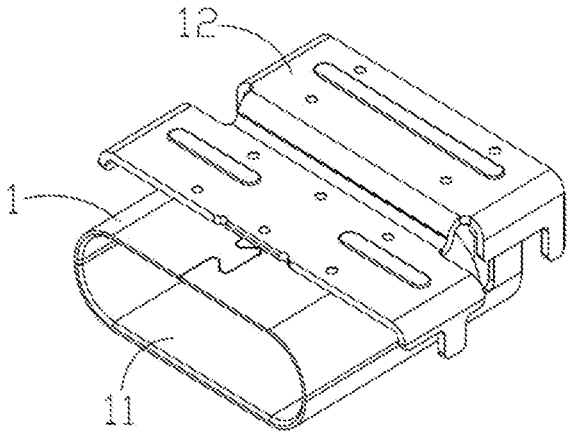
FIG. 1 is a schematic perspective view of a connector from a first view angle according to the first embodiment of the present disclosure.
Figure 2:
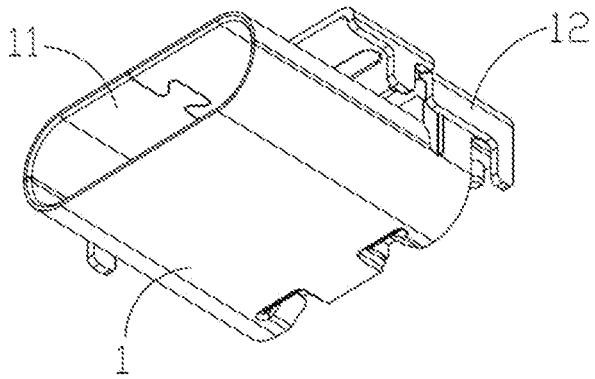
FIG. 2 is a schematic perspective view of the connector of FIG. 1 from a second view angle.

Drawings will be used below to disclose a plurality of embodiments of the present disclosure. For the sake of clear illustration, many practical details will be explained together in the description below. However, it is appreciated that the practical details should not be used to limit the claimed scope. In other words, in some embodiments of the present disclosure, the practical details are not essential. Moreover, for the sake of drawing simplification, some customary structures and elements in the drawings will be schematically shown in a simplified way. Wherever possible, the same reference numbers are used in the drawings and the description to refer to the same or like parts.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As shown in FIGS. 1-4, a connector includes a shielding case 1, an insulating main body 2 and a terminal group 3. The terminal group 3 is accommodated in the insulating main body 2. The insulating main body 2 is covered by the shielding case 1. The shielding case 1 has an opening 11 for allowing a docking plug (not shown) to insert therein. A shielding cover 12 is disposed on the top of the shielding case 1. The shielding cover 12 is configured to prevent the interference from external electromagnetic waves, in which the external electromagnetic waves will affect the transmission of internal electronic signals. The terminal group 3 has terminals 6. Each of the terminals 6 has a contact portion 7 and a connecting portion 8. The contact portions 7 are arranged in two rows in the opening 11 of the shielding case 1. The connecting portions 8 are fixed to the insulating main body 2. The connecting portions 8 of a portion of the terminals 6 extend outwards from the insulating main body 2 to form welding legs 38. The welding legs 38 are arranged in the same row. The insulating main body 2 has a base portion 21, an isolation sheet 22, a first module 23 and a second module 24. The connecting portions 8 of the terminals 6 are respectively connected to the first module 23 and the second module 24 by insert molding. The isolation sheet 22 can be used to isolate the first module 23 from the second module 24, so as to prevent the formation of noises among the terminals 6 on the first module 23 and the second module 24 which will cause mutual interference. The base portion 21 has slots 25. The contact portions 7 of the terminals 6 are accommodated in the slots 25.

Figure 3:
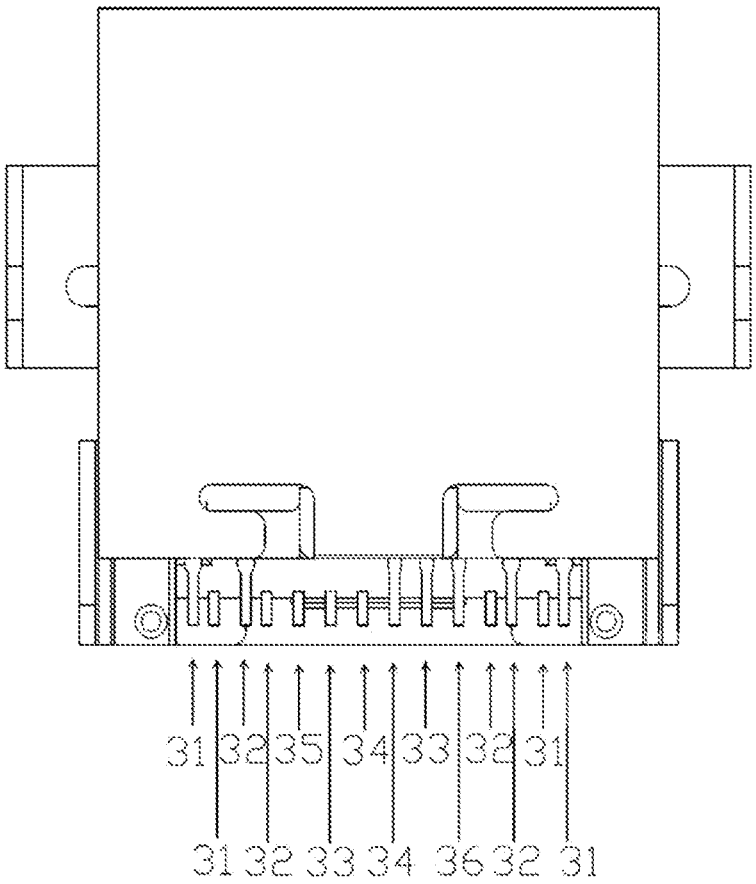
FIG. 3 is a schematic bottom view of the connector of FIG. 1.
Figure 4:
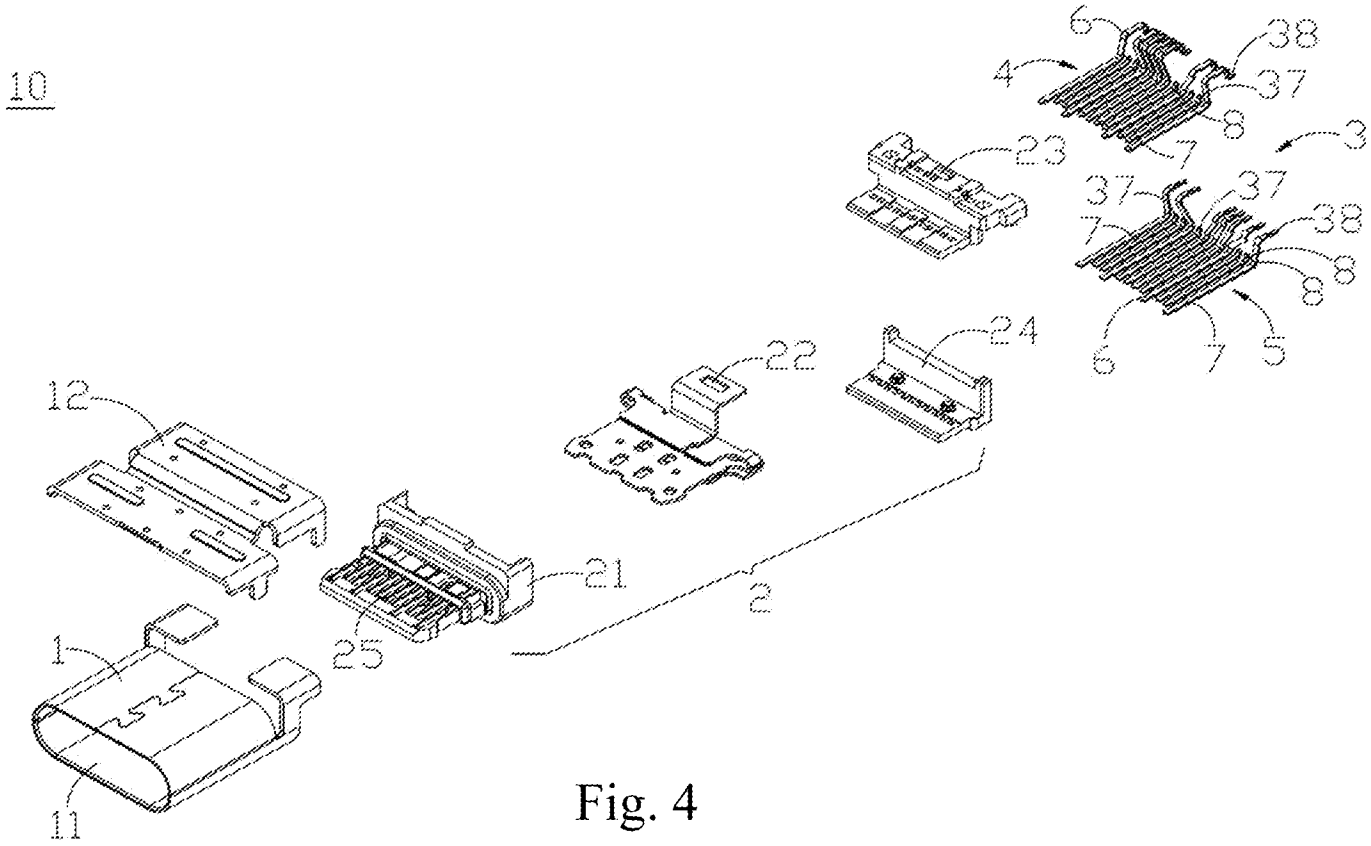
FIG. 4 is a schematic exploded view of the connector of FIG. 1 from the first view angle.
Figure 5:
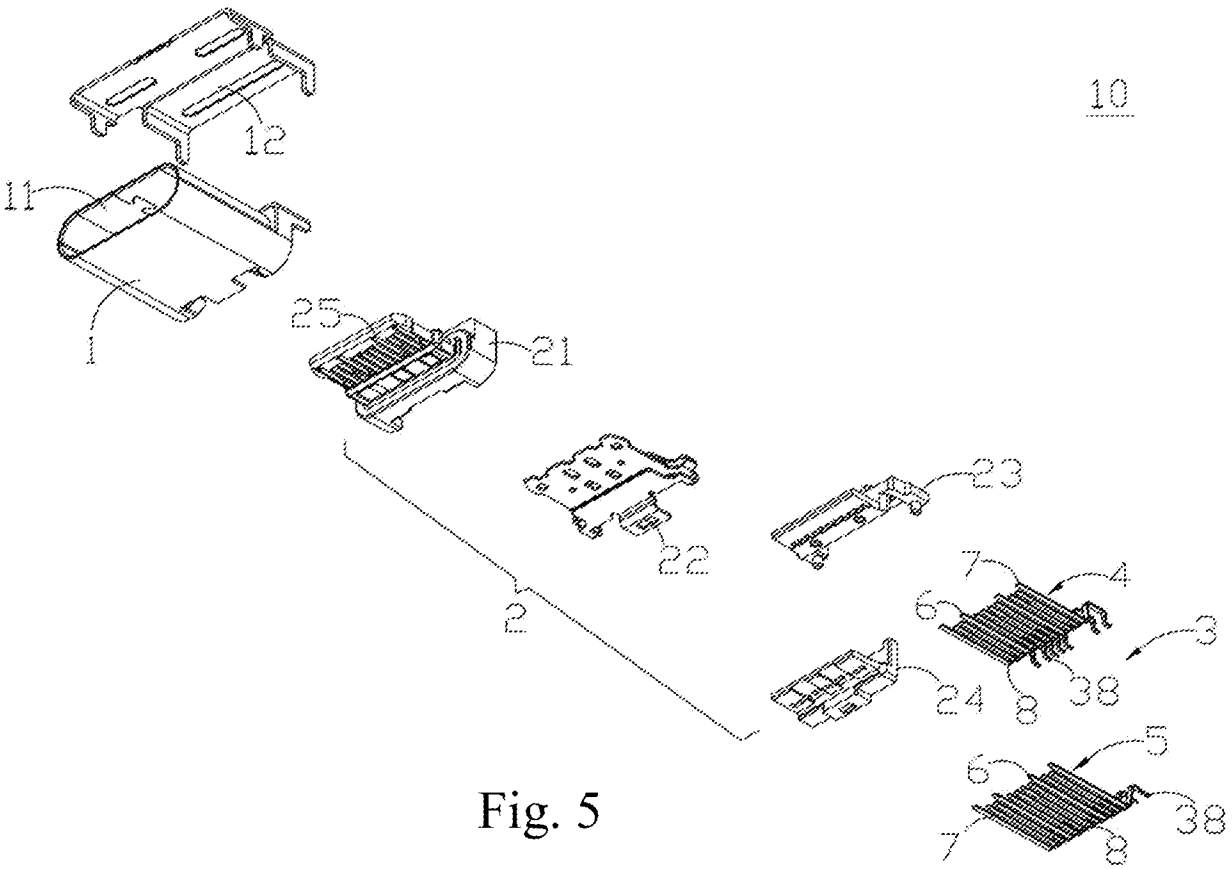
FIG. 5 is a schematic exploded view of the connector of FIG. 1 from the second view angle.

As shown in FIGS. 3-5, in the first embodiment of the present disclosure, the terminal group 3 includes an upper terminal row 4 and a lower terminal row 5. The connecting portions 8 of the upper terminal row 4 are connected to the first module 23 by insert molding. The welding leg 38 of the upper terminal row 4 includes two grounding legs GND 31, two power supply legs Vbus 32, a transmission leg D+ 33, a receiving leg D− 34 and a first signal leg CC1 35. The arrangement pattern of the welding leg 38 of the upper terminal row 4 sequentially from left to right is the grounding leg GND 31, the power supply leg Vbus 32, the first signal leg CC1 35, the transmission leg D+ 33, the receiving leg D− 34, the power supply leg Vbus 32 and the grounding leg GND 31. The connecting portions 8 of the lower terminal row 5 are connected to the second module 24 by insert molding. The welding leg 38 of the lower terminal row 5 includes two grounding legs GND 31, two power supply legs Vbus 32, a transmission leg D+ 33, a receiving leg D− 34 and a second signal leg CC2 36. The arrangement pattern of the welding leg 38 of the lower terminal row 5 sequentially from left to right is the grounding leg GND 31, the power supply leg Vbus 32, the receiving leg D− 34, the transmission leg D+ 33, the second signal leg CC2 36, the power supply leg Vbus 32 and the grounding leg GND 31. Each of the grounding legs GND 31 of the upper terminal row 4 and the lower terminal row 5 are placed in the same region on the circuit board (not shown), and the region is configured for grounding. Each of the power supply legs Vbus 32 of the upper terminal row 4 and the lower terminal row 5 are placed in the same block on the circuit board (not shown), and the block is configured for power transmission.

As shown in FIGS. 3-5, in the first embodiment of the present disclosure, the welding legs 38 of the upper terminal row 4 and the welding legs 38 of the lower terminal row 5 are staggered to form the same row. Each of the welding legs 38 is pulled outwards to bend and form. Each terminal of the upper terminal row 4 is bent outwards to form a pattern of U shape, and each terminal of the lower terminal row 5 is bent outwards to form a pattern of L shape, and all of the terminals are configured to form a single row matching with the circuit design of the circuit board (not shown). The arrangement pattern of the one single row in the first embodiment is in sequence the grounding leg GND 31 of the lower terminal row 5, the grounding leg GND 31 of the upper terminal row 4, the power supply leg Vbus 32 of the lower terminal row 5, the power supply leg Vbus 32 of the upper terminal row 4, the first signal leg CC1 35, the transmission leg D+ 33 of the upper terminal row 4, the receiving leg D− 34 of the upper terminal row 4, the receiving leg D− 34 of the lower terminal row 5, the transmission leg D+ 33 of the lower terminal row 5, the second signal leg CC2 36, the power supply leg Vbus 32 of the upper terminal row 4, the power supply leg Vbus 32 of the lower terminal row 5, the grounding leg GND 31 of the upper terminal row 4 and the grounding leg GND 31 of the lower terminal row 5. The total number of the aforementioned welding legs 38 14. The terminal group 3 is Surface Mounting Technology (SMT) compliant and electrically connected to the circuit board (not shown).

As shown in FIGS. 4-5, in the first embodiment of the present disclosure, the upper terminal row 4 and the lower terminal row 5 have broken legs 37. The broken legs 37 are the terminals 6 with no function. Only the contact portions 7 and the connecting portions 8 of the broken legs 37 are reserved. The contact portion 7 is accommodated in each of the slots 25 of the base portion 21 of the insulating main body 2. The contact portion 7 is to be electrically connected to a docking plug (not shown). After the connecting portion 8 of the upper terminal row 4 is connected to the first module 23 by insert molding, and the connecting portion 8 of the lower terminal row 5 is connected to the second module 24 by insert molding, the first module 23 and the second module 24 are respectively reassembled with the base portion 21. The connecting portions 8 of the broken legs 37 are configured to assist the accuracy of positioning the terminal group 3 and the insulating main body 2 during assembly. When the connector 10 is electrically connected to a docking plug (not shown), the docking plug can be electrically connected to the connector 10 successfully no matter whether the docking plug is inserted in the right direction or in the reverse direction.

Figure 6:
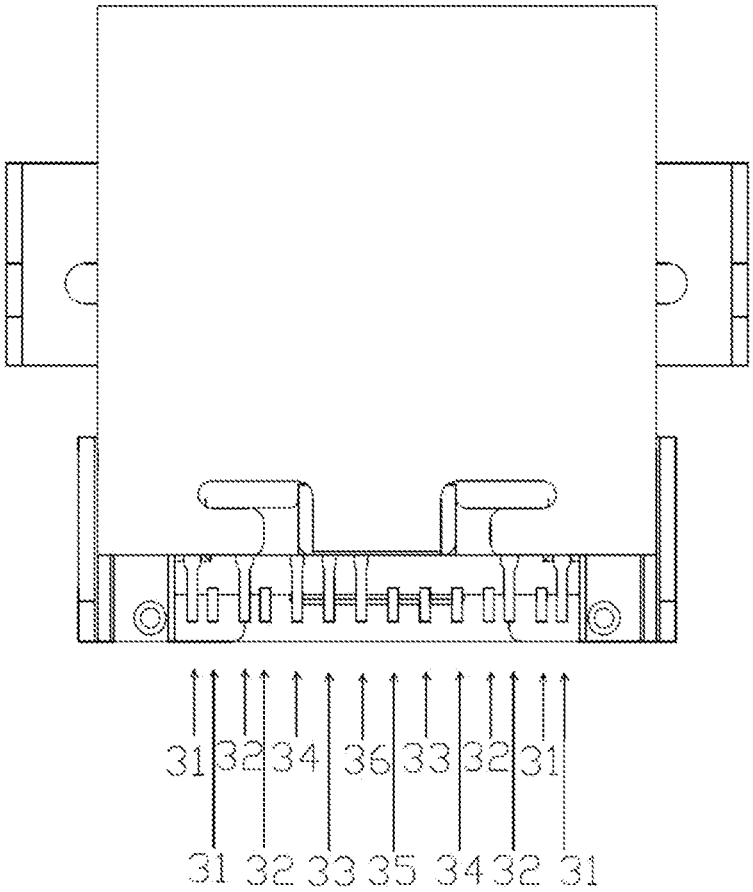
FIG. 6 is a schematic bottom view of an connector according to the second embodiment of the present disclosure.
Figure 7:
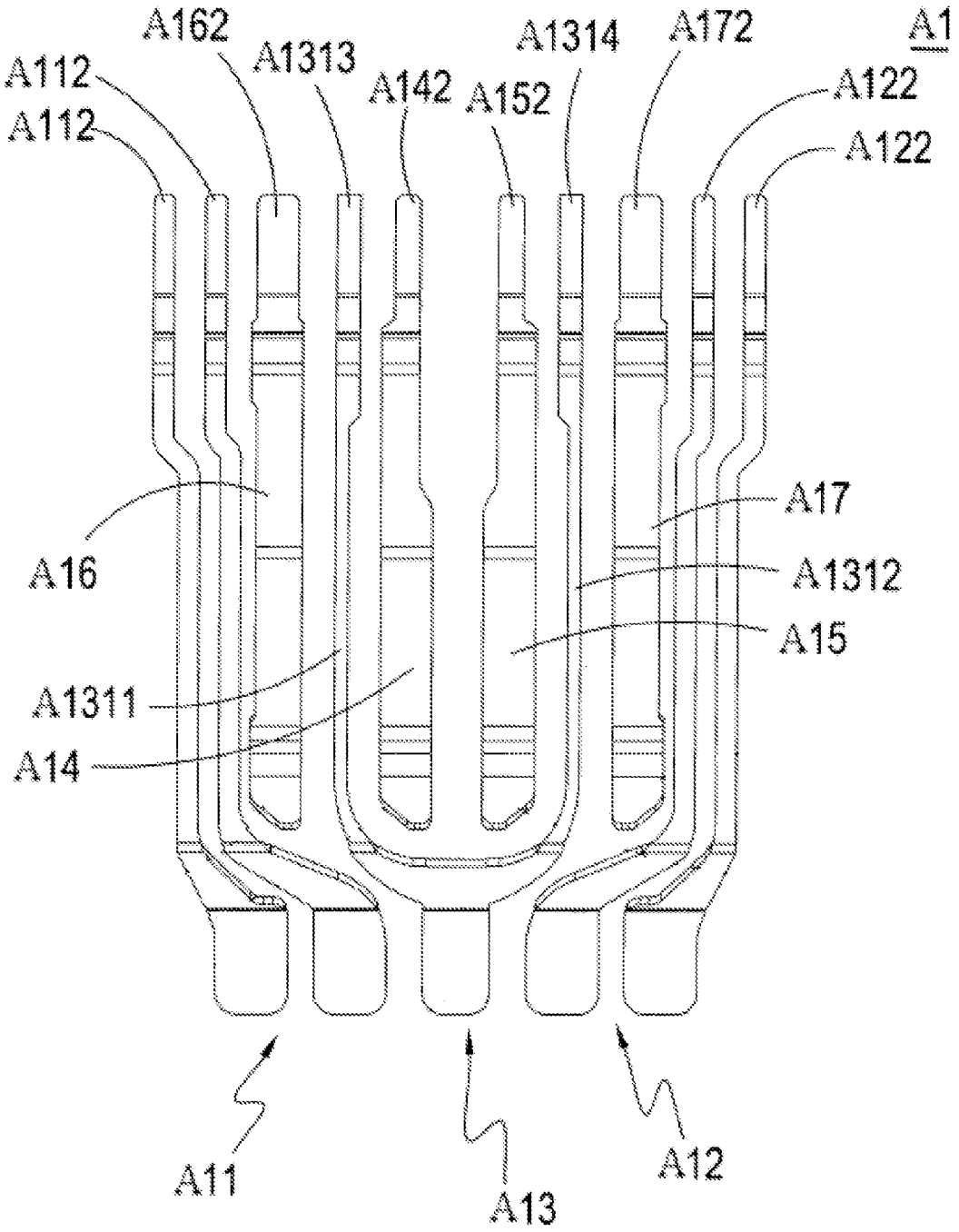
Fig. 7 (Prior Art)
FIG. 7 is schematic view of a terminal disclosed in Taiwan patent No. M469651.

As shown in FIGS. 5-6, in the second embodiment of the present disclosure, the arrangement pattern of the one single row of the upper terminal row 4 and the lower terminal row 5 in sequence is the grounding leg GND 31 of the lower terminal row 5, the grounding leg GND 31 of the upper terminal row 4, the power supply leg Vbus 32 of the lower terminal row 5, the power supply leg Vbus 32 of the upper terminal row 4, the receiving leg D− 34 of the lower terminal row 5, the transmission leg D+ 33 of the lower terminal row 5, the second signal leg CC2 36, the first signal leg CC1 35, the transmission leg D+ 33 of the upper terminal row 4, the receiving leg D− 34 of the upper terminal row 4, the power supply leg Vbus 32 of the upper terminal 4, the power supply leg Vbus 32 of the lower terminal row 5, the grounding leg GND 31 of the upper terminal row 4 and the grounding leg GND 31 of the lower terminal row 5. The total number of the aforementioned welding legs 38 is 14. The terminal group 3 is electrically connected to the circuit board (not shown), and is Surface Mounting Technology (SMT) compliant.

Although the present disclosure has been described in considerable detail with reference to certain embodiments thereof, other embodiments are possible. Therefore, the spirit and scope of the appended claims should not be limited to the description of the embodiments contained herein.

It will be apparent to the person having ordinary skill in the art that various modifications and variations can be made to the structure of the present disclosure without departing from the scope or spirit of the present disclosure. In view of the foregoing, it is intended that the present disclosure cover modifications and variations of the present disclosure provided they fall within the scope of the following claims.

What is claimed is:

1. A connector, comprising:

a shielding case having an opening for allowing a docking plug to be insert therein;

an insulating main body covered by the shielding case; and a terminal group accommodated in the insulating main body, the terminal group having a plurality of terminals arranged as an upper terminal row and a lower terminal row, each terminal of the upper terminal row being bent outwards to form a pattern of U shape, and each terminal of the lower terminal row being bent outwards to form a pattern of L shape, each of the terminals having a contact portion and a connecting portion, the contact portions being arranged in two rows in the opening of the shielding case, the connecting portions being fixed to the insulating main body;

wherein the connecting portions of a portion of the terminals extend outwards from the insulating main body to form a plurality of welding legs, and the welding legs are arranged in the same row.

2. The connector of claim 1, wherein the terminal group comprises an upper terminal row and a lower terminal row, and the upper terminal row comprises two grounding legs, two power supply legs, a transmission leg, a receiving leg, and a first signal leg.

3. The connector of claim 2, wherein the lower terminal row comprises two grounding legs, two power supply legs, a transmission leg, a receiving leg, and a second signal leg.

4. The connector of claim 2, wherein the welding legs of the upper terminal row and the welding legs of the lower terminal row are staggered to form the same row.

5. The connector of claim 2, wherein the upper terminal row and the lower terminal row have a plurality of broken legs, and the broken legs are terminals with no function.

6. The connector of claim 1, wherein the terminal group is surface mounting technology (SMT) compliant, and electrically connected to a circuit board.

* * * * *